United States Patent [19]

Jelinek

[11] Patent Number: 4,892,296

[45] Date of Patent: Jan. 9, 1990

[54] SUCTION TABLE ASSEMBLY

[75] Inventor: Vaclav Jelinek, River Edge, N.J.

[73] Assignee: SSMC Inc., Fairfield, N.J.

[21] Appl. No.: 316,044

[22] Filed: Feb. 27, 1989

[51] Int. Cl.[4] ..... B25B 11/00

[52] U.S. Cl. ..... 269/21

[58] Field of Search ..... 294/64 R, 65; 248/362, 248/363; 269/21; 279/3; 51/235

[56] References Cited

U.S. PATENT DOCUMENTS

| | | | |
|---|---|---|---|
| 2,572,640 | 10/1951 | Lovegrove | 269/21 |
| 2,895,706 | 7/1959 | Blatherwick | 269/21 |
| 3,910,621 | 10/1975 | Hillier | 269/21 |
| 4,131,267 | 12/1978 | Ono et al. | 269/21 |
| 4,504,045 | 3/1985 | Kenbo et al. | 269/21 |

*Primary Examiner*—Robert C. Watson
*Attorney, Agent, or Firm*—Theodore C. Jay

[57] ABSTRACT

A suction table assembly utilizes a member having a hollow interior with open top and bottom horizontal ends. A partition arrangement is disposed in the interior of the member to partition the member interior into a plurality of cubicles having hollow interiors, each cubicle having open top and bottom horizontal ends respectively flush with the top and bottom ends of the member. A flat perforated horizontal plate overlies the member and is connected to the top ends of all of the cubicles, the perforations in the plate communicating with the interiors of the underlying cubicles. The perforations have like areas and are regularly spaced. A suction producing device producing suction forces is disposed below the bottom ends of the member. A shutter mechanism disposed between and connected to the bottom ends of the cubicles and the suction producing device applies the suction forces to the interiors of the cubicles. The shutter mechanism has a plurality of different suction distributing positions, the amount of suction force applied to each cubicle interior varying in accordance with each different suction distributing position.

6 Claims, 1 Drawing Sheet

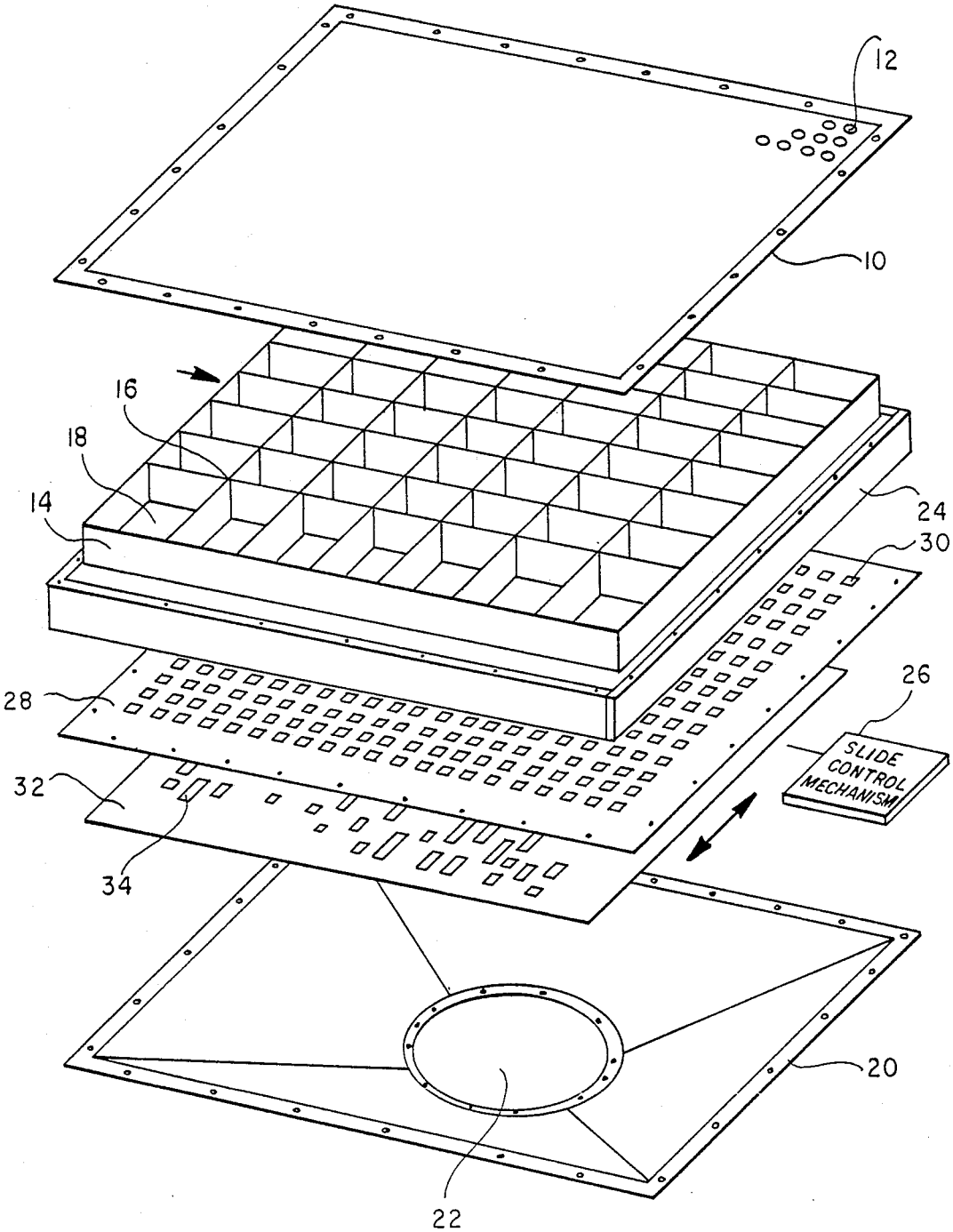
12
10
16
18
14
24
30
28
26
SLIDE CONTROL MECHANISM
32
34
20
22

SUCTION TABLE ASSEMBLY

BACKGROUND OF THE INVENTION

In order to automate the handling and sewing together of pieces of fabric to produce articles of clothing, it is often necessary to momentarily hold in flat position and then to release flat, flexible pieces of fabric. Equipments known as suction table assemblies can be used for this purpose. Conventionally, such equipments employ a plurality of hollow cubicles to which suction forces are applied and controlled by means of a plurality of suction control valves, louvers, ducts and fans.

The present invention is directed toward a new type of suction table assembly wherein the use of suction control valves, louvers and ducts is eliminated. This new type of suction table assembly can be manufactured more easily and at less cost than the conventional assembly described above. Moreover, it is more durable than the conventional assembly and is more flexible in use since the distribution of suction forces in the new type of assembly is more easily modified as required by changes in clothing production methods.

SUMMARY OF THE INVENTION

In accordance with the principles of this invention, a suction table assembly comprises a member having a hollow interior with open top and bottom horizontal ends.

A partition arrangement is disposed in the interior of the member to partition the member interior into a plurality of cubicles having hollow interiors, each cubicle having open top and bottom horizontal ends respectively flush with the top and bottom ends of the member. A flat perforated horizontal plate overlies the member and is connected to the top ends of all of the cubicles. The perforations in the plate communicate with the interiors of the underlying cubicles. The perforations have like areas and are regularly spaced.

Suction producing means for producing suction forces is disposed below the bottom ends of the member. Shutter means disposed between and connected to the bottom ends of the cubicles and the suction producing means applies the suction forces to the interiors of the cubicles. The shutter means has a plurality of different suction distributing positions, the amount of suction force applied to each cubicle interior varying in accordance with each different suction distribution position.

The perforated plate constitutes a first plate. The shutter means includes second and third horizontal plates. One of the second and third plates has regularly spaced openings of like area; the other of the second and third plates has a plurality of openings having different areas and being irregularly spaced. All of these openings are substantially larger in area than each perforation in the first plate. One of the second and third plates is disposed djacent the bottom ends of the cubicles and its openings communicate therewith. The other of the second and third plates is disposed below the one of the second and third plates.

The second and third plates are slidable with respect to each other,with one of these two plates being fixed in position while the other of these two plates is slidable into a plurality of different discrete positions, each different discrete position corresponding to a corresponding one of the plurality of different suction distributing positions, the distribution of suction forces applied to the cubicle interiors depending upon the relative alignments and misalignments of the openings in the second and third plates.

By replacing either one or both of the second and third plates with other plates having differently positioned openings and/or openings of different areas, the number of different suction distributing positions and/or the magnitude or number of suction forces can be varied as desired or shut off.

BRIEF DESCRIPTION OF THE DRAWINGS

The accompanying single FIGURE is a perspective exploded view of a preferred embodiment of this invention.

DETAILED DESCRIPTION OF PREFERRED EMBODIMENTS

Referring now to the Figure, a first plate in the form of a flat flexible retroreflective metal sheet 10 having uniformly disposed closely spaced perforations 12 overlies a member 14 having a hollow interior with open top and bottom horizontal openings. A partition arrangement 16 disposed in the interior of the member partitions this interior into a plurality of like cubicles 18, each cubicle having open top and bottom horizontal ends respectively flush with the top and bottom ends of the member. The perforations 12 of sheet 10 communicates with the interiors of the underlying cubicles. Essentially the same number of perforations communicate with the interior of each cubicle.

Suction producing means consists of an upwardly and outwardly flaring fan housing 20 having a lowered central opening in which a suction producing electric fan 22 is disposed. Disposed between the fan housing and the cubicles is suitable shutter means. A suitable frame 24 connects all components together.

The shutter means includes second and third horizontal plates which are disposed one below the other in the housing above the fan and adjacent the cubicles. One of these plates is fixed in place; the other is horizontally slidable with respect thereto. A suitable mechanism 26 for accomplishing this sliding action, permitting the slidable plate to obtain a selected number of different discrete positions with respect to the fixed plate can be a short stroke air cylinder or several cylinders arranged in series. Typically, the sliding force for a 15 square foot table and suction of 8 inches of water for moving the sliding plate will not exceed 70 pounds per square inch and the total length of plate displacement for 3 positions will be about one inch depending on suction area.

One or both plates can be made of plastic. As shown, plate 28 is disposed adjacent the cubicles, is fixed in place and is provided with a plurality of uniformly spaced openings 30 of uniform shape and area whereby a like number of openings 30 communicate with the interior of each cubicle. Plate 32 is slidably disposed below plate 28 and is provided with a plurality of openings 34 which differ in shape and area and which are not uniformly spaced. Thus, depending upon the relative positions of plates 28 and 32, the distribution and amount of suction forces applied to the cubicles can be varied as desired. In one of the discrete positions of plate 32, all of the openings in plate 28 can be completely out of alignment with the openings in plate 32 so that no suction forces are applied to the cubicle interiors. If desired the positions of plates 28 and 32 can be interchanged.

The openings 30 and 34 can have various shapes as for example circular or rectangular.

When the slidable plate is disposed below the fixed plate, the slidable plate must be so constructed as to prevent deformation under the influence of suction forces. When the slidable plate is disposed between the fixed plate and the cubicles, it is much less subject to such deformation and can be constructed accordingly.

What is claimed is:

1. A suction table assembly comprising:

a member having a hollow interior with open top and bottom horizontal ends;

a partition arrangement disposed in the interior of the member to partition the member interior into a plurality of cubicles having hollow interiors, each cubicle having open top and bottom horizontal ends respectively flush with the top and bottom ends of the member;

a first flat perforated horizontal plate overlying the member and connected to the top ends of all of the cubicles, the perforations in the plate communicating with the interiors of the underlying cubicles, the perforations having like areas and being regularly spaced;

suction producing means for producing suction forces, said suction producing means being disposed below the bottom ends of the member; and shutter means disposed between and connected to the bottom ends of the cubicles and the suction producing means, the shutter means applying the suction forces to the interiors of the cubicles, the shutter means having a plurality of different suction distributing positions, the amount of suction applied to each cubicle interior varying in accordance with each different suction distributing position, the shutter means including a second horizontal plate with regularly spaced openings of like area disposed below the bottom ends of the member, each opening having a substantially larger area than each perforation in the first plate.

2. The assembly of claim 1 wherein the shutter means includes a third horizontal plate with a plurality of openings having different areas and being irregularly spaced, said third plate being disposed adjacent the second plate, one of the second and third plates being horizontally slidable with respect to the other plate, the interiors of the cubicles being adjacent and communicating with a selected one of said second and third plates.

3. The assembly of claim 2 wherein one of said second and third plates is fixed and the other is slidable into a plurality of different discrete positions, each different discrete position corresponding to a corresponding one of the plurality of different suction distributing positions, the distribution of suction forces applied to the cubicle interiors depending upon the relative alignments and misalignments of the openings in the second and third plates.

4. THe assembly of claim 3 wherein the suction producing means includes a suction producing electric fan and a housing in which the fan is disposed.

5. The assembly of claim 4 further including means connected to the slidable one of the second and third plates for applying sliding force thereto to position said slidable plate selectively in any one of the different discrete positions.

6. The assembly of claim 5 wherein in one of the discrete positions, all of the openings in one of the second and third plates are out of alignment with all of the openings in the other of said second and third plates so that no suction forces are applied to the cubicle interiors.

* * * * *